US006830317B2

(12) United States Patent
Tsuchii et al.

(10) Patent No.: US 6,830,317 B2
(45) Date of Patent: Dec. 14, 2004

(54) INK JET RECORDING HEAD

(75) Inventors: Ken Tsuchii, Kanagawa (JP); Mineo Kaneko, Tokyo (JP); Keiichiro Tsukuda, Kanagawa (JP); Masaki Oikawa, Tokyo (JP); Kenji Yabe, Kanagawa (JP); Keiji Tomizawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/419,839

(22) Filed: Apr. 22, 2003

(65) Prior Publication Data

US 2003/0197760 A1 Oct. 23, 2003

(30) Foreign Application Priority Data

Apr. 23, 2002 (JP) ..... 2002-121209

(51) Int. Cl.[7] ..... B41J 2/05
(52) U.S. Cl. ..... 347/56
(58) Field of Search ..... 347/63, 65, 67, 347/48, 20, 56, 61, 15, 45, 47, 43, 92

(56) References Cited

U.S. PATENT DOCUMENTS

| | | | | |
|---|---|---|---|---|
| 4,746,935 A | * | 5/1988 | Allen | 347/15 |
| 5,208,605 A | * | 5/1993 | Drake | 347/15 |
| 5,412,410 A | | 5/1995 | Rezanka | |
| 5,682,190 A | | 10/1997 | Hirosawa et al. | 347/94 |
| 6,174,049 B1 | | 1/2001 | Tachihara et al. | 347/65 |
| 6,412,920 B1 | | 7/2002 | Matsumoto et al. | 347/58 |
| 2002/0063752 A1 | | 5/2002 | Clark | |
| 2002/0063756 A1 | | 5/2002 | Tsuchii et al. | 347/65 |

FOREIGN PATENT DOCUMENTS

| | | |
|---|---|---|
| EP | 0 719 647 | 7/1996 |
| EP | 1 186 414 | 3/2002 |
| JP | 2002-178520 | 6/2002 |

* cited by examiner

*Primary Examiner*—K. Feggins
*Assistant Examiner*—An H. Do
(74) *Attorney, Agent, or Firm*—Fitzpatrick, Cella, Harper & Scinto

(57) ABSTRACT

In an ink jet recording head from which a small ink droplet and a large ink droplet can be discharged, a common liquid chamber is connected to discharge ports via ink flow paths and pressure chambers, and ink droplets are discharged from the discharge ports by utilizing thermal energy of heaters. Widths of the ink flow paths are narrower than widths of the pressure chambers so that the ink flow paths act as restriction portions. If it is assumed that a sectional area of the small liquid droplet ink flow path is $S_S$, a sectional area of the small liquid droplet pressure chamber is $S_{RS}$, a sectional area of the large liquid droplet ink flow path is $S_L$ and a sectional area of the large liquid droplet pressure chamber is $S_{RL}$, a relationship $S_S/S_{RS}<S_L/S_{RL}$ is established.

30 Claims, 10 Drawing Sheets

INK JET RECORDING HEAD

BACKGROUND OF THE INVENTION

1. Field of the Invention

The present invention relates to an ink jet recording head for performing recording by discharging an ink droplet from a discharge port and by adhering the ink droplet onto a recording medium.

2. Related Background Art

As one of the ink discharging methods in ink jet recording apparatuses, which are now used widely, there is a method utilizing an electro-thermal converting element (heater). The principle is that heat is generated by applying an electrical signal to the electro-thermal converting element disposed in a pressure chamber to which ink is supplied, thereby heating the ink near the electro-thermal converting element instantaneously to boil the ink, with the result that the ink is discharged from a discharge port externally by great bubble pressure abruptly generated due to phase change. An ink jet recording head of this type has advantages that the structure is simple and that integration of ink flow paths is facilitated.

In such an ink jet recording head, there is a case where recording is performed by forming an ink droplet finer than the normal ink droplet in order to realize highly fine recording. To this end, there has been proposed an arrangement in which the discharging of the larger ink droplet and the discharging of the smaller ink droplet are used properly. In general, it can be considered that the discharge port and the electro-thermal converting element must be miniaturized in order to discharge the smaller ink droplet.

Concretely, in order to reduce the size of the discharged liquid droplet, the discharge port area is made smaller substantially in inverse proportion to the discharge amount. For example, when an ink droplet of 5 pl is preferably discharged from a discharge port having a diameter of 16 to 16.5 $\mu$m (area is 201 to 214 $\mu m^2$), it is considered to be preferable that a discharge port for discharging a smaller ink droplet (for example, 4 pl) has a diameter of about 15.5 $\mu$m (area is 189 $\mu m^2$) and a discharge port for discharging a more smaller ink droplet (for example, 2 pl) has a diameter of about 10.5 $\mu$m (area is 87 $\mu m^2$).

According to a normal design method, when the discharge port and the electro-thermal converting element are miniaturized in order to discharge the small ink droplet, the pressure chamber within which the electro-thermal converting element is installed is also miniaturized accordingly. An ink flow path for connecting the pressure chamber to a common liquid chamber is designed to have a width the same as the width of the pressure chamber. That is to say, in correspondence to the miniaturization of the ink droplet, the discharge port, electro-thermal converting element and pressure chamber are all miniaturized at the same rate, and the pressure chamber and the ink flow path are formed to have the same width.

However, in such a design method, it was found that there is a case where the minute ink droplet may not be discharged successfully. That is to say, even if a small liquid discharging nozzle is constructed by reducing the dimensions of the discharge port, electro-thermal converting element and pressure chamber which can discharge the normal ink droplet (large ink droplet) successfully in proportion to the reduction of the ink amount of the ink droplet to be discharged, in many cases, good ink droplet discharging cannot be achieved. It is guessed that one of factors causing the poor discharging is the fact that flow resistance is increased by the miniaturization of the discharge port.

Explaining this more concretely, the viscosity resistance of the discharge port is increased in inverse proportion to fourth power of the area of the discharge port. That is to say, when the discharge port is miniaturized in correspondence to the miniaturization of the ink droplet, since the viscosity resistance is increased, in order to maintain the proper discharging condition if the viscosity resistance is increased, the bubbling power generated by the electro-thermal converting element must be increased. In the above-mentioned conventional design method, although it was considered that the bubbling power of the electro-thermal converting element can merely be decreased in accordance with the miniaturization of the discharged ink droplet, actually, it is considered that, in addition to this, bubbling power required for is overcoming the increased viscosity resistance should be considered. Accordingly, the minimum bubbling power required for discharging the ink droplet from the discharge port successfully cannot eventually be reduced much in comparison with the case where the large ink droplet is discharged, because the fact that the power can be reduced in accordance with the miniaturization of the ink droplet to be discharged is cancelled out by the fact that the power must be increased to cope with the increase in viscosity resistance, with the result that the size of the electro-thermal converting element cannot be reduced much.

Further, due to limitation of the design of the ink jet recording head, in a certain case, the distance between the electro-thermal converting element and the discharge port cannot be shortened in accordance with the miniaturization of the ink droplet to be discharged and the discharge port. That is to say, there is a case where the distance between the electro-thermal converting element and the discharge port becomes constant by forming the discharge port for discharging the large ink droplet and the discharge port for discharging the small ink droplet in a single substrate and installing the corresponding electro-thermal converting elements in parallel on the single substrate in order to simplify the construction and the manufacturing process. In this case, even when the diameter of the discharge port is decreased in accordance with the miniaturization of the ink droplet to be discharged, the distance to the discharge port cannot be shortened, thereby causing bad balance. Since the distance to the discharge port is long relatively, the energy required for discharging the ink out of the discharge port becomes relatively great.

Also for this reason, the minimum energy required for discharging the ink droplet cannot be reduced much in comparison with the rate of reduction of the amount of the ink droplet and the rate of the miniaturization of the discharge port, and the size of the electro-thermal converting element cannot be reduced much in comparison with the electro-thermal converting element for discharging the large ink droplet.

For example, in the above-mentioned example, if the electro-thermal converting element used for discharging the ink droplet of 5 pl has a square shape of 26 $\mu$m×26 $\mu$m (or two elements having a dimension of 12.5 $\mu$m×28 $\mu$m), the electro-thermal converting element for discharging the ink droplet of 4 pl is required to have a square shape of about 24 $\mu$m×24 $\mu$m, and, the electro-thermal converting element required for discharging the ink droplet of 2 pl becomes a square shape of about 22 $\mu$m×22 $\mu$m (or two elements having a dimension of about 11.5 $\mu$m×27 $\mu$m). As such, while the discharge port can be miniaturized in accordance with the reduction of the dimensions of the ink droplet, in comparison with this, the electro-thermal converting element cannot be miniaturized so much.

Further, the pressure chamber for discharging the small ink droplet cannot be miniaturized so much since it must contain the electro-thermal converting element. When a margin of 2 μm is provided around an outer periphery of the electro-thermal converting element in consideration of alignment error of a flow path forming member, for example, the pressure chamber required for discharging the ink droplet of 5 pl must have a square shape of (26+4) μm×(26+4) μm=30 μm×30 μm (bottom area is 900 $\mu m^2$) or a square shape of (12.5×2+3+4) μm×(28+4) μm=32 μm×32 μm (bottom area is 1,024 $\mu m^2$). In contrast, the pressure chamber required for discharging the ink droplet of 4 pl has a square shape of (24+4) μm×(24+4) μm=28 μm×28 μm (bottom area is 784 $\mu m^2$), and the pressure chamber required for discharging the ink droplet of 2 pl has a square shape of (22+4) μm×(22+4) μm=26 μm×26 μm (bottom area is 676 $\mu m^2$) or a rectangular shape of (11.5×2+3+4) μm×(27+4) μm=30 μm×31 μm (bottom area is 930 $\mu m^2$).

As such, when the minute ink droplet is discharged, the electro-thermal converting element and the pressure chamber cannot be miniaturized so much in comparison with the rate of the miniaturization of the discharge port.

As mentioned above, since an ink flow path having the same width of that of the pressure chamber is normally provided, when the pressure chamber is not miniaturized so much, the width of the ink flow path is not reduced so much. As a result, of the bubbling power of the electro-thermal converting eminent, a power component directed toward the ink flow path side rather than the discharge port side and not contributing to the discharging of the ink droplet is increased so as to cause great loss, thereby worsening the energy efficiency.

SUMMARY OF THE INVENTION

Accordingly, an object of the present invention is to provide an ink jet recording head in which loss can be reduced and energy efficiency can be enhanced also in a nozzle for discharging a small ink droplet, on the basis of a unique designing method, which is unknown in the prior art.

The present invention provides an ink jet recording head in which pressure chambers are connected to a plurality of respective ink flow paths branched from a common liquid chamber, discharge ports are communicated with the respective pressure chambers, ink supplied from the common liquid chamber to each pressure chamber can be discharged from the corresponding discharge port by pressure generated in the pressure chamber by heat from a corresponding electro-thermal converting element, and wherein the plurality of pressure chambers include a small liquid droplet pressure chamber for discharging a small liquid droplet and a large liquid droplet pressure chamber for discharging a large liquid droplet, and, regarding the ink flow path for the small liquid droplet connected to the small liquid droplet pressure chamber, the small liquid droplet pressure chamber, the ink flow path for the large liquid droplet connected to the large liquid droplet pressure chamber and the large liquid droplet pressure chamber, when sections substantially perpendicular to ink flows directed from the respective ink flow paths to the respective pressure chambers are looked at, a relationship between a sectional area $S_S$ of the small liquid droplet ink flow path, a sectional area $S_{RS}$ of the small liquid droplet pressure chamber, a sectional area $S_L$ of the large liquid droplet ink flow path and a sectional area $S_{RL}$ of the large liquid droplet pressure chamber satisfies $S_S/S_{RS}<S_L/S_{RL}$. Further, it is preferable that a relationship between the sectional area $S_{RS}$ of the small liquid droplet pressure chamber and the sectional area $S_{RL}$ of the large liquid droplet pressure chamber and an ink amount $I_S$ of the small liquid droplet discharged from the small liquid droplet pressure chamber and an ink amount $I_L$ of the large liquid droplet discharged from the large liquid droplet pressure chamber satisfies $S_{RS}/S_{RL}>I_S/I_L$.

Further, it is preferable that a relationship between a volume $V_{RS}$ of the small liquid droplet pressure chamber and a volume $V_{RL}$ of the large liquid droplet pressure chamber and the ink amount $I_S$ of the small liquid droplet discharged from the small liquid droplet pressure chamber and the ink amount $I_L$ of the large liquid droplet discharged from the large liquid droplet pressure chamber satisfies $V_{RS}/V_{RL}>I_S/I_L$.

Further, $S_L=S_{RL}$ and $S_S<S_{RS}$ may be satisfied.

Further, it is preferable that the following relationships are satisfied:

$$S_{Lb} \leq S_{Sb} < 1.93\ S_{Lb}$$

$$S_{Lb}=R_{Lf}/(R_{Lf}+R_{Lb})\times S_{Le}$$

$$S_{Sb}=R_{Sf}/(R_{Sf}+R_{Sb})\times S_{Se}$$

where $S_{Lb}$: flow resistance of large liquid droplet side;

$S_{Sb}$: flow resistance of small liquid droplet side;

$R_{Lf}$: flow resistance from electro-thermal converting element of large liquid droplet pressure chamber to corresponding discharge port;

$R_{Lb}$: flow resistance from electro-thermal converting element of large liquid droplet ink flow path to common liquid chamber;

$S_{Le}$: effective bubbling area of the large liquid droplet electro-thermal converting element;

$R_{Sf}$: flow resistance from electro-thermal converting element of small liquid droplet pressure chamber to corresponding discharge port;

$R_{Sb}$: flow resistance from electro-thermal converting element of small liquid droplet ink flow path to common liquid chamber; and $S_{Se}$: effective bubbling area of small liquid droplet electro-thermal converting element.

Further, the following relationships or equations may be satisfied:

$$Rf = n\int_0^H D(x)\,dx/S(x)^2$$

$$D(x)=12.0\times(0.33+1.02\times(a(x)/b(x)+b(x)/a(x)))$$

where $R_f$: flow resistance from electro-thermal converting element to corresponding discharge port;

H: distance from electro-thermal converting element to corresponding discharge port;

x: distance from electro-thermal converting element;

S(x): sectional area of ink flow path at position of distance x;

D(x): section coefficient of ink flow path at position of distance x;

a(x): height of ink flow path at position of distance x;

b(x): width of ink flow path at position of distance x; and
η: ink viscosity, and, $$Rb = n\int_0^L D(y)\,dy/S(y)^2$$

$$D(y)=12.0\times(0.33+1.02\times(c(y)/d(y)+d(y)/c(y)))$$

where $R_b$: flow resistance from electro-thermal converting element to common liquid chamber;
L: distance from center of electro-thermal converting element to common liquid chamber;
y: distance from the common liquid chamber;
S(y): sectional area of ink flow path at position of distance y;
D(y): section coefficient of ink flow path at position of distance y;
c(y): height of ink flow path at position of distance y; and
d(y): width of ink flow path at position of distance Further, the following relationships may be satisfied:

$$Rf = n\sum_{n=1}^{k} D(x_n)(x_n - x_{n-1})/S(x_n)^2$$

$$D(x_n)=12.0\times(0.33+1.02\times(a(x_n)/b(x_n)+b(x_n)/a(x_n)))$$

where $R_f$: flow resistance from electro-thermal converting element to corresponding discharge port;
k: division number of distance from electro-thermal converting element to corresponding discharge port;
$x_n$: distance from electro-thermal converting element to n-th division position when distance from electro-thermal converting element to corresponding discharge port is divided into k sections;
$S(x_n)$ sectional area of ink flow path at position of $x_n$;
$D(x_n)$: section coefficient of ink flow path at position of $x_n$;
$a(x_n)$: height of ink flow path at position of $x_n$;
$b(x_n)$: width of ink flow path at position of $x_n$; and
η: ink viscosity, and, $$Rb = n\sum_{n=1}^{l} D(y_n)(y_n - y_{n-1})/S(y_n)^2$$

$$D(y_n)=12.0\times(0.33+1.02\times(c(y_n)/d(y_n)+d(y_n)/c(y_n)))$$

where $R_b$: flow resistance from electro-thermal converting element to common liquid chamber;
l: division number of distance from center of electro-thermal converting element to common liquid chamber;
$y_n$: distance from common liquid chamber to n-th division position when distance from center of electro-thermal converting element to common liquid chamber is divided into l sections;
$S(y_n)$: sectional area of ink flow path at position of $y_n$;
$D(y_n)$: section coefficient of ink flow path at position of $y_n$;
$c(y_n)$: height of ink flow path at position of $y_n$; and
$d(y_n)$: width of ink flow path at position of $y_n$.

Further, the following relationships may be satisfied:

$$Rf = \rho\int_0^H dx/S(x)$$

where $R_f$: flow resistance from electro-thermal converting element to corresponding discharge port;
H: distance from electro-thermal converting element to corresponding discharge port;
x: distance from electro-thermal converting element;
S(x): sectional area of ink flow path at position of distance x; and
ρ: ink density, and, $$Rb = \rho\int_0^L dy/S(y)$$

where $R_b$: flow resistance from electro-thermal converting element to common liquid chamber;
L: distance from center of electro-thermal converting element to common liquid chamber;
y: distance from the common liquid chamber; and
S(y): sectional area of ink flow path at position of distance y.

Further, the following relationships may be satisfied:

$$Rf = \rho\sum_{n=1}^{k} (x_n - x_{n-1})/S(x_n)$$

where $R_f$: flow resistance from electro-thermal converting element to corresponding discharge port;
k: division number of distance from electro-thermal converting element to corresponding discharge port;
$x_n$: distance from electro-thermal converting element to n-th division position when distance from electro-thermal converting element to corresponding discharge port is divided into k sections;
$S(x_n)$: sectional area of ink flow path at position of $x_n$; and
η: ink viscosity, and, $$Rb = \rho\sum_{n=1}^{l} (y_n - y_{n-1})/S(y_n)$$

where $R_b$: flow resistance from electro-thermal converting element to common liquid chamber;
l: division number of distance from center of electro-thermal converting element to common liquid chamber;
$y_n$: distance from common liquid chamber to n-th division position when distance from center of electro-thermal converting element to common liquid chamber is divided into l sections; and
$S(y_n)$: sectional area of ink flow path at position of $y_n$.

DESCRIPTION OF THE PREFERRED EMBODIMENTS

Now, embodiments of the present invention and reference examples will be explained with reference to the accompanying drawings.

First Reference Example

Figure 1A:
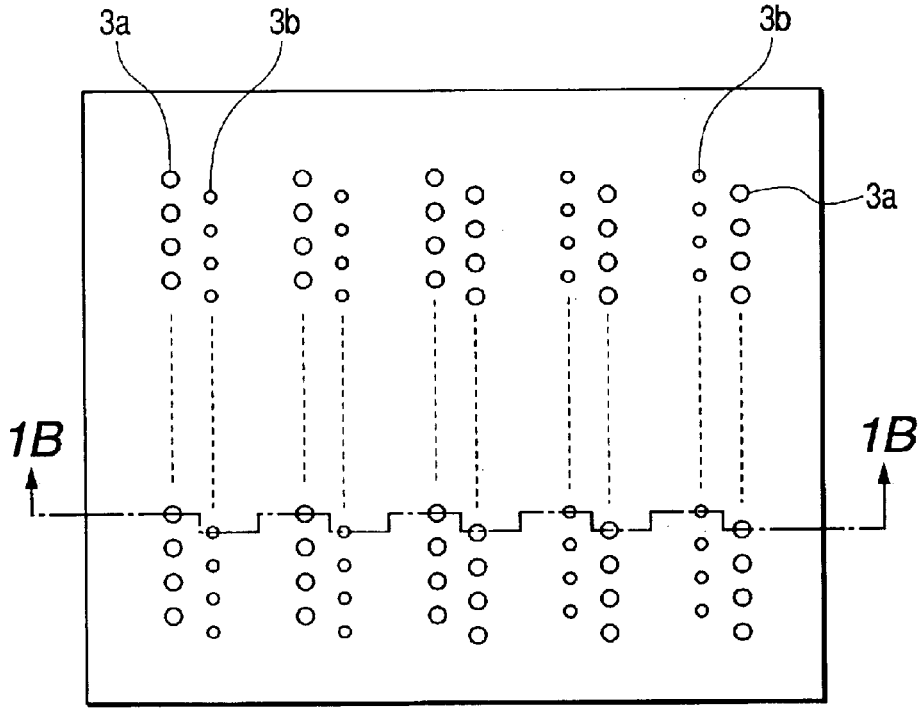
FIG. 1A is a schematic plan view showing a fundamental construction of an ink jet recording head according to a first reference example.
Figure 1B:
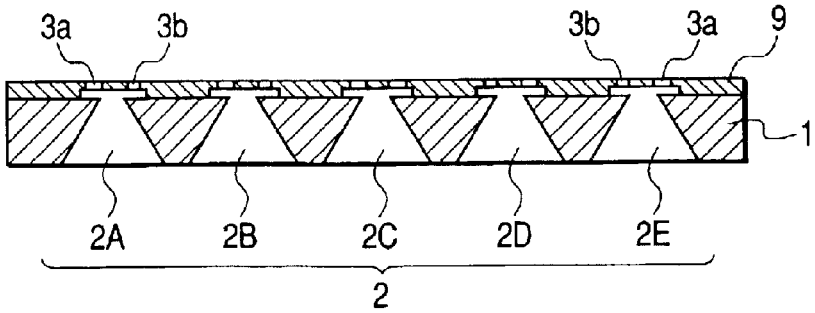
FIG. 1B is a sectional view thereof.

An ink jet recording head according to a first reference example is shown in FIGS. 1A and 1B and FIGS. 2A and 2B. As shown in FIGS. 1A and 1B, in a fundamental construction of the ink jet recording head, five ink supply ports 2 are formed in a single substrate 1, and cyan ink is supplied to the ink supply ports 2A and 2E, magenta ink is supplied to the ink supply ports 2B and 2D and yellow ink is supplied to the ink supply port 2C. A discharge port plate 9 to be joined to the substrate 1 is provided with large liquid droplet discharge ports 3*a* for discharging large liquid droplets and small liquid droplet discharge ports 3*b* for discharging small liquid droplets with respect to the respective ink supply ports 2. Regarding the ink supply ports 2A and 2B, the large liquid droplet discharge ports 3*a* are disposed at a left side in FIGS. 1A and 1B and small liquid droplet discharge ports 3*b* are disposed at a right side in FIGS. 1A and 1B. Regarding the ink supply ports 2D and 2E, the small liquid droplet discharge ports 3*b* are disposed at a left side in FIGS. 1A and 1B and the large liquid droplet discharge ports 3*a* are disposed at a right side in FIGS. 1A and 1B, and, regarding the ink supply port 2C, the large ink droplet discharge ports 3*a* are disposed on both sides. Accordingly, if the substrate 1 is shifted in either direction along an arrangement direction of the ink supply ports 2 (left-and-right direction in FIGS. 1A and 1B), the order for discharging the ink colors onto a recording medium (not shown) becomes the same, thereby preventing generation of color unevenness.

Figure 2A:
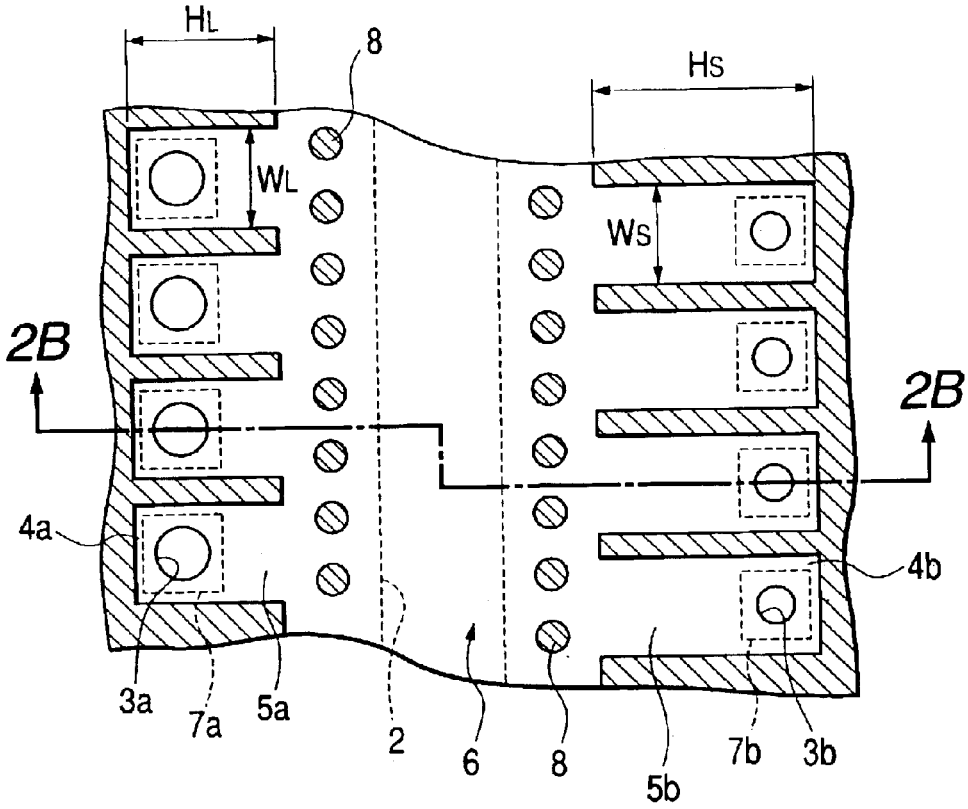
FIG. 2A is an enlarged plan view showing a main part of the ink jet recording head according to the first reference example shown in FIG. 1A with part of the structure omitted.
Figure 2B:
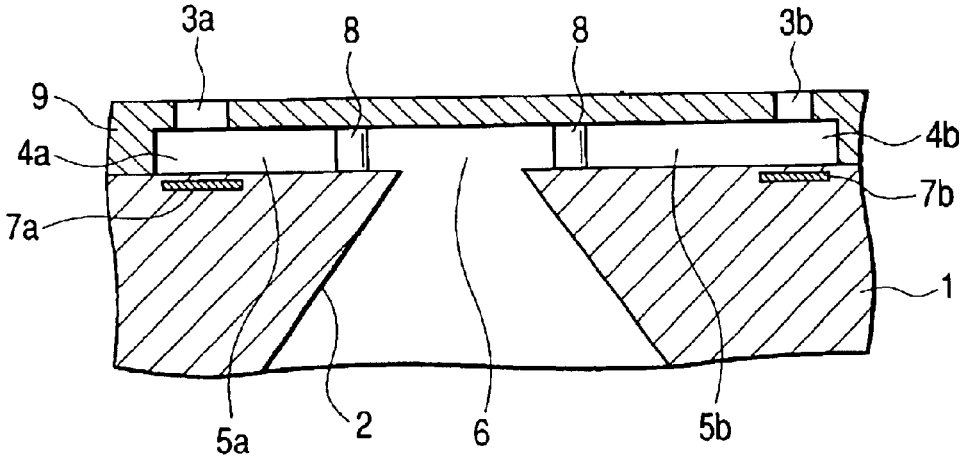
FIG. 2B is a sectional view taken along the line 2B—2B.

As shown in enlarged views of FIGS. 2A and 2B illustrating left side portions of FIGS. 1A and 1B, the large liquid droplet discharge port 3*a* is provided at one side of each ink supply port 2 and the small liquid droplet discharge port 3*b* is provided at the other side. The discharge ports 3*a* and 3*b* are communicated with a common liquid chamber 6 via pressure chambers 4*a* and 4*b* and ink flow paths 5*a* and 5*b*, respectively, and the common liquid chamber 6 is communicated with the ink supply ports 2. Electro-thermal converting elements (referred to as "heaters" hereinafter) 7*a* and 7*b* are disposed within the pressure chambers 4*a* and 4*b*, respectively. Incidentally, in this specification, the portion including the ink flow path continued to the pressure chamber is generically referred to as a "nozzle." A cylindrical nozzle filter 8 integrally formed with the discharge port plate 9 is disposed in the vicinity of portions of the common liquid chamber 6 to which the ink flow paths 5*a* and 5*b* are connected.

When it is assumed that a length of the nozzle for the large liquid droplet is $H_L$, a length of the nozzle for the small liquid droplet is $H_S$, a width of the nozzle for the large liquid droplet (=width of large liquid droplet ink flow path 5*a*) is $W_L$ and a width of the nozzle for the small liquid droplet (=width of the small liquid droplet ink flow path 5*b*) is $W_S$, in this reference example, $H_L<H_S$ and $W_L=W_S$ are satisfied. Thus, the flow resistance of the small liquid droplet ink flow path 5*b* becomes great. Incidentally, the dimensions of $H_L$, $H_S$, $W_L$ and $W_S$ are within a range in which the flow resistance satisfies the following relationships:

$$S_{Lb} \leq S_{Sb} < 1.93\ S_{Lb}$$

$$S_{Lb} = R_{Lf}/(R_{Lf}+R_{LB}) \times S_{Le}$$

$$S_{Sb} = R_{Sf}/(R_{Sf}+R_{Sb}) \times S_{Se}$$

where $S_{Lb}$: flow resistance of large liquid droplet side;

$S_{Sb}$: flow resistance of small liquid droplet side;

$R_{Lf}$: flow resistance from electro-thermal converting element of large liquid droplet pressure chamber to corresponding discharge port;

$R_{Lb}$: flow resistance from electro-thermal converting element of large liquid droplet ink flow path to common liquid chamber;

$S_{Le}$: effective bubbling area of the large liquid droplet electro-thermal converting element;

$R_{Sf}$: flow resistance from electro-thermal converting element of small liquid droplet pressure chamber to corresponding discharge port;

$R_{Sb}$: flow resistance from electro-thermal converting element of small liquid droplet ink flow path to common liquid chamber; and $S_{Se}$: effective bubbling area of small liquid droplet electro-thermal converting element.

Further, the flow resistances $R_f$ and $R_b$ are represented by the following relationships or equations, respectively:

$$Rf = n\int_0^H D(x)\,dx/S(x)^2$$

$$D(x)=12.0\times(0.33+1.02\times(a(x)/b(x)+b(x)/a(x)))$$

where $R_f$: flow resistance from electro-thermal converting element to corresponding discharge port;

H: distance from electro-thermal converting element to corresponding discharge port;
x: distance from electro-thermal converting element;
S(x): sectional area of ink flow path at position of distance x;
D(x): section coefficient of ink flow path at position of distance x;
a(x): height of ink flow path at position of distance x;
b(x): width of ink flow path at position of distance x; and
η: ink viscosity, and, $$Rb = n\int_0^L D(y)\,dy/S(y)^2$$

$$D(y)=12.0\times(0.33+1.02\times(c(y)/d(y)+d(y)/c(y)))$$

where
$R_b$: flow resistance from electro-thermal converting element to common liquid chamber;
L: distance from center of electro-thermal converting element to common liquid chamber;
y: distance from the common liquid chamber;
S(y): sectional area of ink flow path at position of distance y;
D(y): section coefficient of ink flow path at position of distance y;
c(y): height of ink flow path at position of distance y; and
d(y): width of ink flow path at position of distance y.

Further, when the flow resistances $R_f$ and $R_b$ are obtained from dispersion calculations, the following relationships can be obtained:

$$Rf = \eta\sum_{n=1}^{k} D(x_n)(x_n - x_{n-1})/S(x_n)^2$$

$$D(x_n)=12.0\times(0.33+1.02\times(a(x_n)/b(x_n)+b(x_n)/a(x_n)))$$

where
$R_f$: flow resistance from electro-thermal converting element to corresponding discharge port;
k: division number of distance from electro-thermal converting element to corresponding discharge port;
$x_n$: distance from electro-thermal converting element to n-th division position when distance from electro-thermal converting element to corresponding discharge port is divided into k sections;
$S(x_n)$: sectional area of ink flow path at position of $x_n$;
$D(x_n)$: section coefficient of ink flow path at position of $x_n$;
$a(x_n)$: height of ink flow path at position of $x_n$;
$b(x_n)$: width of ink flow path at position of $x_n$; and
η: ink viscosity, and, $$Rb = \eta\sum_{n=1}^{l} D(y_n)(y_n - y_{n-1})/S(y_n)^2$$

$$D(y_n)=12.0\times(0.33+1.02\times(c(y_n)/d(y_n)+d(y_n)/c(y_n)))$$

where
$R_b$: flow resistance from electro-thermal converting element to common liquid chamber;
l: division number of distance from center of electro-thermal converting element to common liquid chamber;
$y_n$: distance from common liquid chamber to n-th division position when distance from center of electro-thermal converting element to common liquid chamber is divided into l sections;
$S(y_n)$: sectional area of ink flow path at position of $y_n$;
$D(y_n)$: section coefficient of ink flow path at position of $y_n$;
$c(y_n)$: height of ink flow path at position of $y_n$; and
$d(x_n)$: width of ink flow path at position of $y_n$.

Further, when the flow resistances are defined by inertance, the following relationships are obtained:

$$Rf = \rho\int_0^H dx/S(x)$$

where
$R_f$: flow resistance from electro-thermal converting element to corresponding discharge port;
H: distance from electro-thermal converting element to corresponding discharge port;
x: distance from electro-thermal converting element;
S(x): sectional area of ink flow path at position of distance x; and
ρ: ink density, and, $$Rb = \rho\int_0^L dy/S(y)$$

where
$R_b$: flow resistance from electro-thermal converting element to common liquid chamber;
L: distance from center of electro-thermal converting element to common liquid chamber;
y: distance from the common liquid chamber; and
S(y): sectional area of ink flow path at position of distance y.

Alternatively, the flow resistances can be represented by the following equations:

$$Rf = \rho\sum_{n=1}^{k}(x_n - x_{n-1})/S(x_n)$$

where
$R_f$: flow resistance from electro-thermal converting element to corresponding discharge port;
k: division number of distance from electro-thermal converting element to corresponding discharge port;
$x_n$: distance from electro-thermal converting element to n-th division position when distance from electro-thermal converting element to corresponding discharge port is divided into k sections;
$S(x_n)$: sectional area of ink flow path at position of $x_n$; and
ρ: ink viscosity, and, $$Rb = \rho\sum_{n=1}^{l}(y_n - y_{n-1})/S(y_n)$$

where
$R_b$: flow resistance from electro-thermal converting element to common liquid chamber;
l: division number of distance from center of electro-thermal converting element to common liquid chamber;
$y_n$: distance from common liquid chamber to n-th division position when distance from center of electro-thermal converting element to common liquid chamber is divided into l sections; and
$S(y_n)$: sectional area of ink flow path at position of $y_n$.

Tests regarding the discharging of the large liquid droplet (discharging amount of 5 pl) and the discharging of the small liquid droplet (discharging amount of 2 pl) were actually performed by using the ink jet recording head according to this reference example, and a relationship between image quality experimentally obtained (particularly, occurrence of a phenomenon in which the discharging is distorted at random to form poor dots) and the flow resistances $S_{Sb}$ and $S_{Lb}$ obtained by the calculations was verified. Results are shown in the following Table 1. In this reference example, the ink discharging was performed by a nozzle No. 1 for discharging the large liquid droplet of 5 pl with nozzles in which various conditions were changed. As shown in the Table 1, an example in which two nozzles No. 1 for discharging the large liquid droplet of 5 p1 are combined and examples in which the nozzle No. 1 is combined with nozzles Nos. 2 to 5 for discharging the small liquid droplet of 2 pl, respectively, were compared.

Incidentally, effective areas of the heaters 7*a* and 7*b* are sought as follows. Since it is difficult to increase the temperature of peripheral zones comprising 2 $\mu$m margins at the edges of the heaters 7*a* and 7*b*, and these zones thus do not contribute to the bubbling, the effective area is calculated as an inside area smaller than the actual size by 2 $\mu$m. For example, the effective area of each heater 7*a* or 7*b* having a size of 22×22 $\mu$m is (22−2×2)×(22−2×2)=18×18=324 $\mu m^2$. Further, a height of each ink flow path 5*a* or 5*b* of this ink jet recording head is 14 $\mu$m, and widths of the flow paths 5*a* and 5*b* are $W_L=W_S=32$ $\mu$m. Incidentally, $R_f$ is the resistance of the discharge port 3*a* or 3*b* alone.

TABLE 1

Relationship between flow resistances $S_{Lb}$, $S_{Sb}$ and image quality

| NozzleNo. | 1 | 2 | 3 | 4 | 5 |
|---|---|---|---|---|---|
| Discharged Amount (pl) | 5 | 2 | 2 | 2 | 2 |
| Discharge Port Diameter ($\mu$m) | 16 | 10.5 | 10.5 | 10.5 | 10.5 |
| Nozzle Filter Diameter ($\mu$m) | 10 | 10 | 10 | 10 | 15 |
| Heater Size ($\mu$m) | 26 × 26 | 26 × 26 | 24 × 24 | 22 × 22 | 26 × 26 |
| Flow Resistance $S_{Lb}$, $S_{Sb}$ ($\mu m^2$) | 199 | 384 | 317 | 257 | 262 |
| $S_{Sb}/S_{Lb}$ Ratio | 1 | 1.93 | 1.59 | 1.29 | 1.32 |
| Image Quality | ○ | X | Δ to ○ | ○ | ○ |

As shown in the above Table 1, in the example in which two nozzles No. 1 for the large liquid droplet are combined, poor printing such as poor dot formation is not generated at all and image quality is good.

In the example in which the nozzle No. 2 having a discharge port diameter smaller than that of the nozzle No. 1 and adapted to discharge the small liquid droplet of 2 pl is combined with the nozzle No. 1, considerable poor dot formation was generated at the nozzle No. 2 and the image quality was very bad. Incidentally, the flow resistance $S_{Sb}$ of the nozzle No. 2 is greater than the flow resistance $S_{Lb}$ of the nozzle No. 1 by 1.93 times.

In the examples in which the nozzle No. 3 having a heater size of 24×24 $\mu$m smaller than that of the nozzle No. 2 and the nozzle No. 4 having a smaller heater size of 22×22 $\mu$m are used, respectively, the poor dot formation was suppressed and the image quality was enhanced. In the nozzle No. 3, in a certain case, although slight poor dot formation was generated, in the nozzle No. 4, the poor dot formation was not generated at all and the image quality was very good. Incidentally, $S_{Sb}/S_{Lb}$ ratios of the nozzles No. 3 and No. 4 are 1.59 and 1.29, respectively.

Further, in the example in which the nozzle No. 5 having a greater diameter of the nozzle filter 8 than that of the nozzle No. 2 to increase the flow resistance $S_{Sb}$ was used, the poor dot formation was not generated so much and the image quality was good. An $S_{Sb}/S_{Lb}$ ratio thereof is 1.32.

From the above-mentioned results, it can be seen that, in order to maintain a good discharging condition of the small liquid droplet, it is important that escaping of the bubbling power toward the direction of the common liquid chamber 6 is suppressed and that cross-talk via the common liquid chamber 6 is suppressed. Quantitatively, in order to suppress the calculated escaping amount of the bubbling power toward the direction of the common liquid chamber 6 to a predetermined amount or less, it is important that various sizes are set on the basis of the above-mentioned relationships or equations. The $S_{Sb}/S_{Lb}$ ratio corresponding to the escaping amount of the bubbling power from the small liquid droplet ink flow path 5*b* to the common liquid chamber 6 must be below at least 1.93 and is more preferably smaller than 1.59. Further, according to the above-mentioned flow resistance calculations, an absolute value of the flow resistance $S_{Sb}$ must also be below 384 $\mu m^2$ and is more preferably smaller than 317 $\mu m^2$.

As mentioned above, by determining the sizes of various parts and the flow resistances on the basis of the above-mentioned calculations, the cross-talk caused by the escaping of the bubbling power toward the common liquid chamber 6 at the small liquid droplet ink flow path 5*b* is reduced, with the result that the liquid droplet discharging is stabilized to prevent poor recording such as poor dot formation, thereby permitting high quality image formation.

Second Reference Example

Figure 3A:
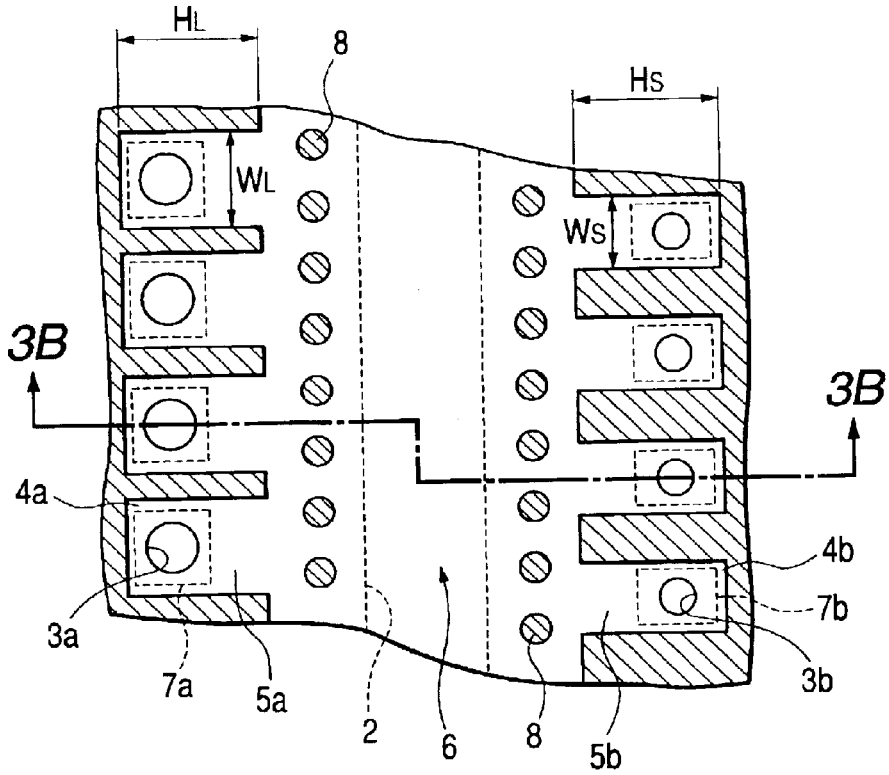
FIG. 3A is an enlarged plan view showing a main part of an ink jet recording head according to a second reference example with part of the structure omitted.
Figure 3B:
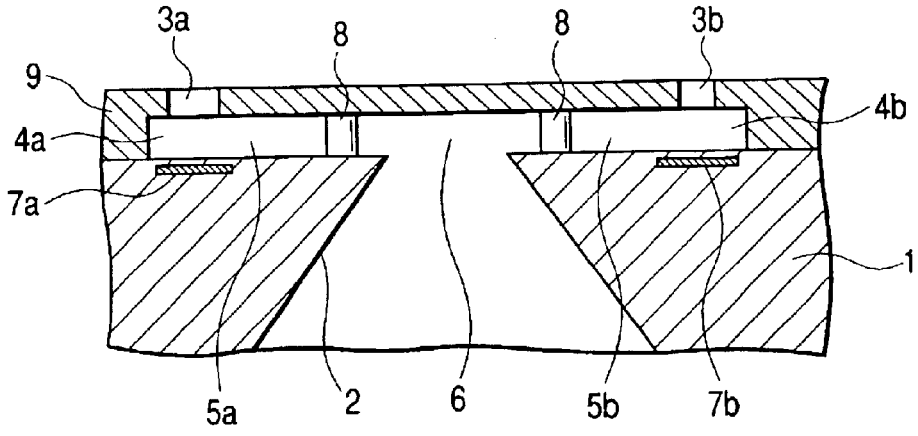
FIG. 3B is a sectional view taken along the line 3B—3B.

Next, an ink jet recording head according to a second reference example will be explained with reference to FIGS. 3A and 3B. Explanation of the same parts as those in the first reference example will be omitted.

In this reference example, $H_L=H_S$ and $W_L>W_S$ are satisfied. The sizes of various parts including $W_S$ are sought by calculations similar to those in the first reference example.

In the first reference example, although there is a problem that the small liquid droplet ink flow paths 5*b* are lengthened and thus the dimension of the entire ink jet recording head is increased, in the second reference example, the flow resistances $S_{Sb}$ of the small liquid droplet ink flow paths 5*b* can be increased without increasing the dimension of the ink jet recording head.

First Embodiment

Figure 4A:
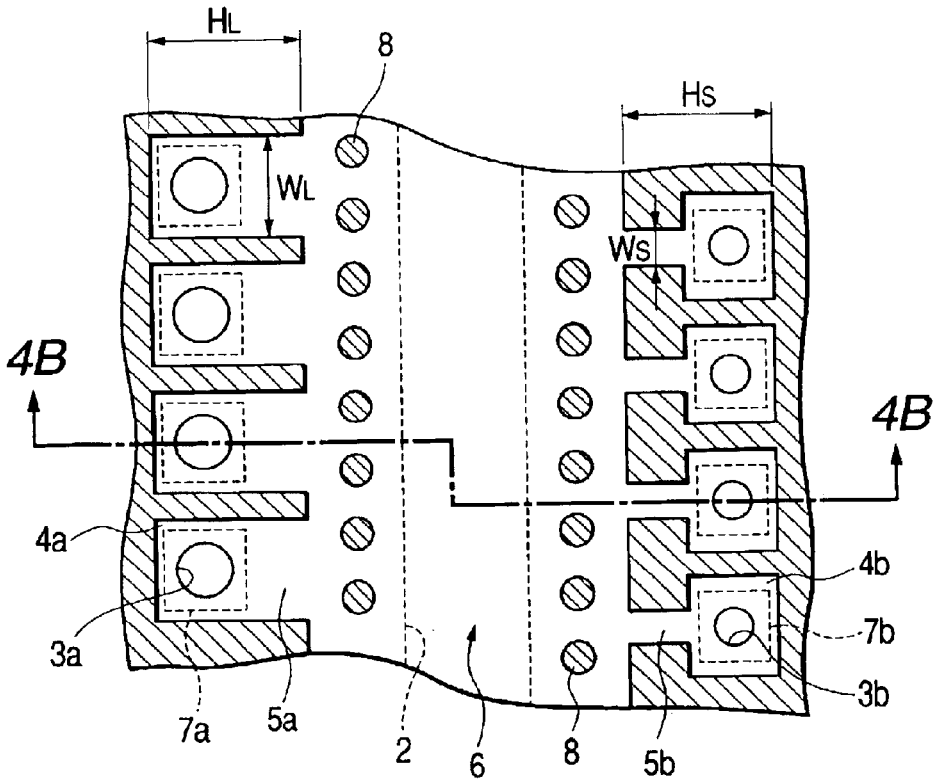
FIG. 4A is an enlarged plan view showing a main part of an ink jet recording head according to a first embodiment of the present invention with part of the structure omitted.
Figure 4B:
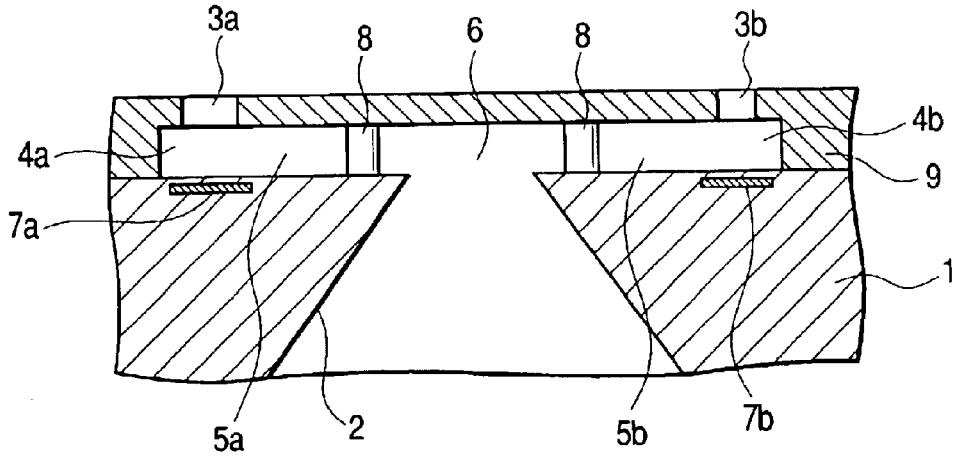
FIG. 4B is a sectional view taken along the line 4B—4B.

Next, a first embodiment of an ink jet recording head of the present invention will be explained with reference to FIGS. 4A and 4B. Explanation of the same parts as those in the first and second reference examples will be omitted.

In the first embodiment, $H_L=H_S$ and $W_L>W_S$ are satisfied, and the width of the small liquid droplet ink flow path 5*b* is smaller than the width of the small liquid droplet pressure chamber 4*b*. That is to say, although the large liquid droplet ink flow path 5*a* is directly connected to the large liquid droplet pressure chamber 4*a* with the same width, the small liquid droplet ink flow path 5*b* has the width smaller than that of the small liquid droplet pressure chamber 4*b*, and, thus, restriction for the ink flow is formed between the ink flow path and the pressure chamber. Incidentally, the sizes of various parts are determined by calculations similar to those in the first reference example.

In the construction of the second reference example, the entire width of the small liquid droplet ink flow path 5*b* is small to make the configuration of the heater 4*b* narrower, thereby limiting the size designing of the heater 4*b*, with the result that the driving designing and the designing of the resistance of the heater film are apt to be limited. Further, positional deviation of the nozzle in a short side direction of the heater 4*b* easily affects an influence upon the discharging direction. Further, there is a problem that, if the effective bubbling area is changed due to long term use, the change rate of the effective bubbling area becomes great. To the contrary, in the first embodiment, the degrees of freedom in the designing of the size of the heater 4*b* are great and the degrees of freedom in the driving designing and the designing of the heater film are great. Further, since the configuration of the heater can be selected as a square, the influence of positional deviation of the nozzle on the discharge direction can be minimized, with the result that the change rate of the effective bubbling area during long term use can be minimized. The other aspects of construction are similar to those in the first reference example.

Second Embodiment

Figure 5A:
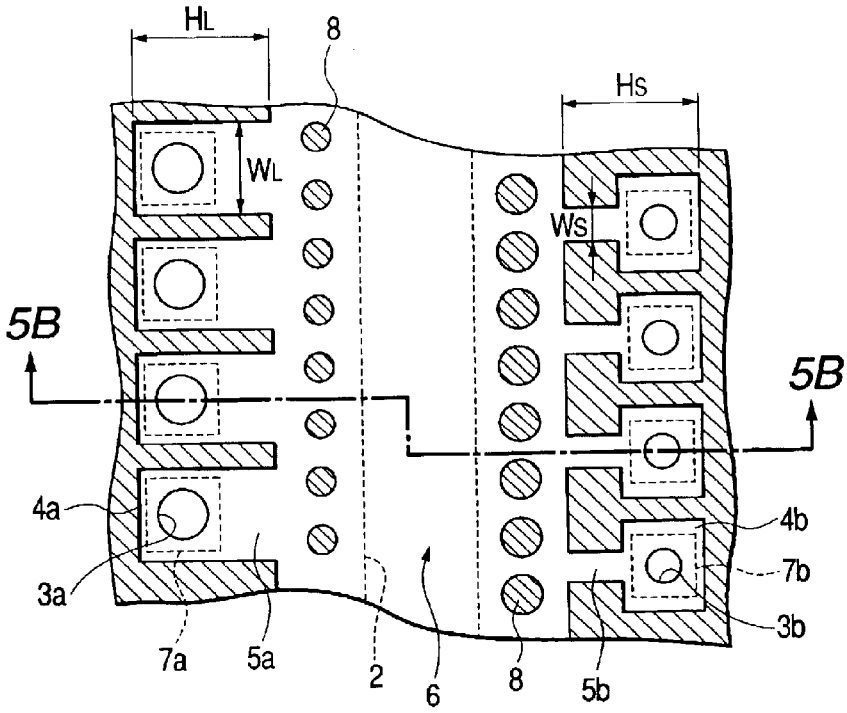
FIG. 5A is an enlarged plan view showing a main part of an ink jet recording head according to a second embodiment of the present invention with part of the structure omitted.
Figure 5B:
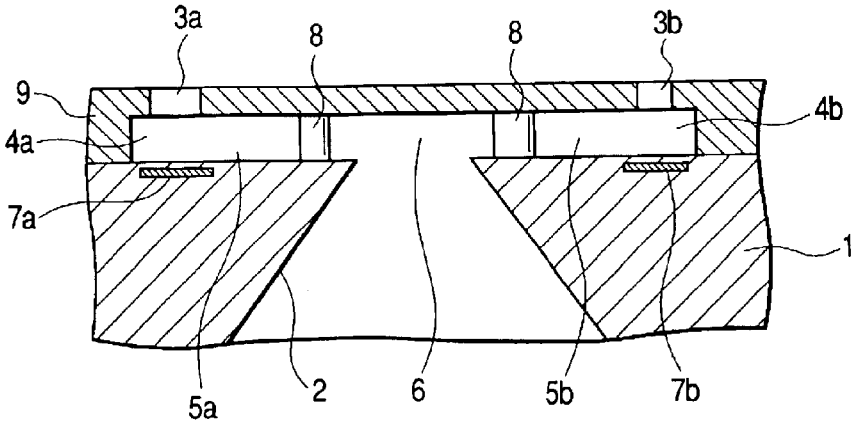
FIG. 5B is a sectional view taken along the line 5B—5B.

Next, a second embodiment of an ink jet recording head of the present invention will be explained with reference to FIGS. 5A and 5B. Explanation of the same parts as those in the first and second reference examples and the first embodiment will be omitted.

In the second embodiment, the diameter of nozzle filter 8 corresponding to the small liquid droplet ink flow path 5*b* is great. The other aspects of construction are the same as those in the first embodiment. The sizes of various parts including the dimensions of the nozzle filter 8 are sought by calculations similar to those in the first reference example.

In the second embodiment, even when the width $W_S$ of the small liquid droplet ink flow path 5*b* is not narrowed extremely, the flow resistance $S_{Sb}$ can be increased and optimized by making the nozzle filter 8 larger. Accordingly, there is little influence of manufacturing tolerance of the ink flow path 5*b*, and it is hard for the dispersion in the flow resistances $S_{Sb}$ of the nozzles for the small liquid droplet to be so great. Further, since the width $W_S$ of the small liquid droplet ink flow path 5*b* is not so narrow and the nozzle filter 8 is large, it is hard for dirt or debris to cause clogging.

Third Reference Example

Figure 6A:
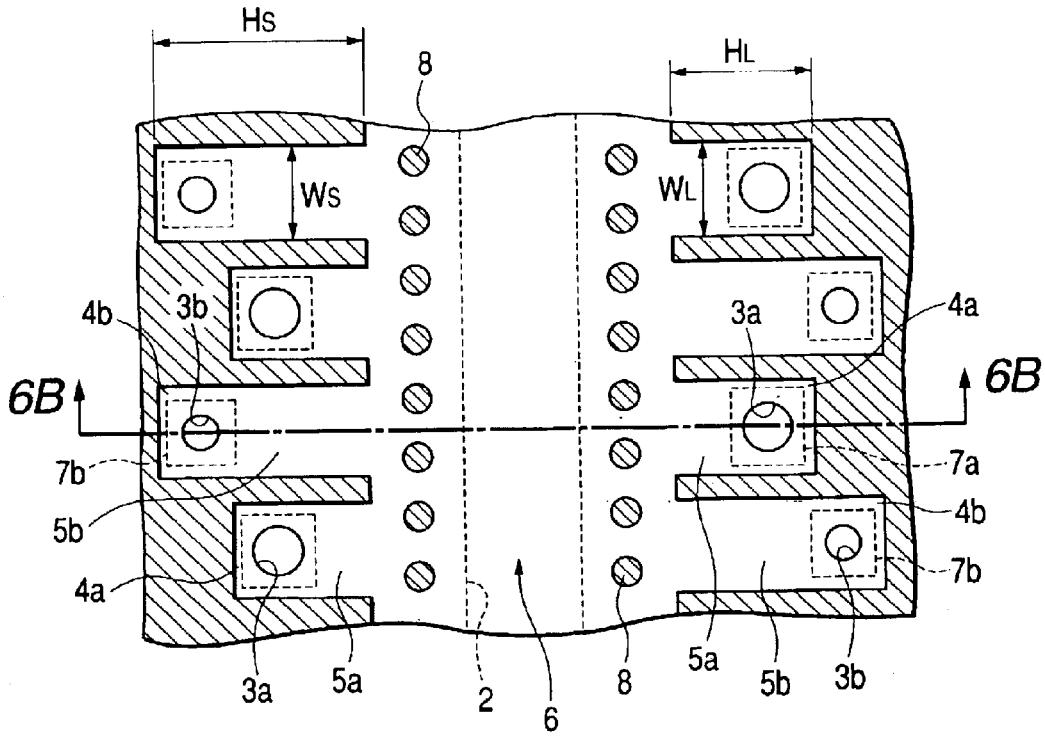
FIG. 6A is an enlarged plan view showing a main part of an ink jet recording head according to a third reference example with part of the structure omitted.
Figure 6B:
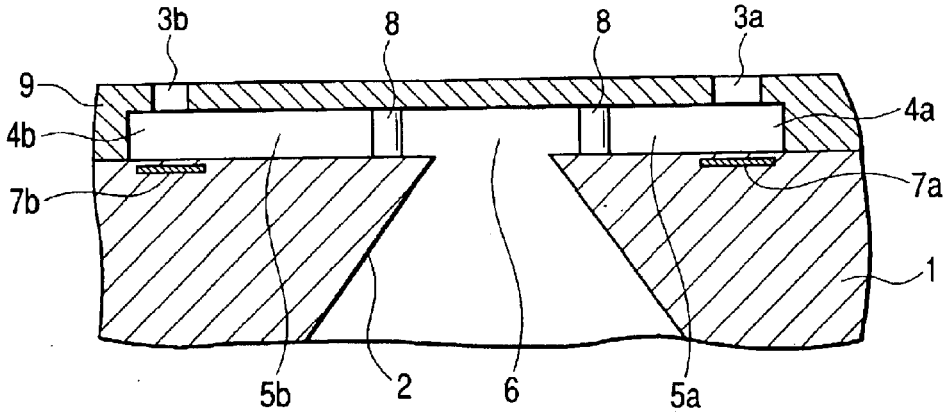
FIG. 6B is a sectional view taken along the line 6B—6B.

Next, an ink jet recording head according to a third reference example will be explained with reference to FIGS. 6A and 6B. Explanation of the same parts as those in the first and second reference examples will be omitted.

In this reference example, the small liquid droplet nozzles and the large liquid droplet nozzles are alternately disposed in the same column. The other aspects of construction are the same as those in the first reference example.

In this reference example, since the distance between the large liquid droplet ink flow paths 5*a* and the distance between the small liquid droplet ink flow paths 5*b* can be widened, cross-talk and the influence of air flow between the large liquid droplet ink flow paths 5*a* or between the small liquid droplet ink flow paths 5*b* caused when high speed printing is performed by using only the large liquid droplets or the small liquid droplets can be reduced, thereby stabilizing the discharging and permitting high speed printing of a high quality image.

Fourth Reference Example

Figure 7A:
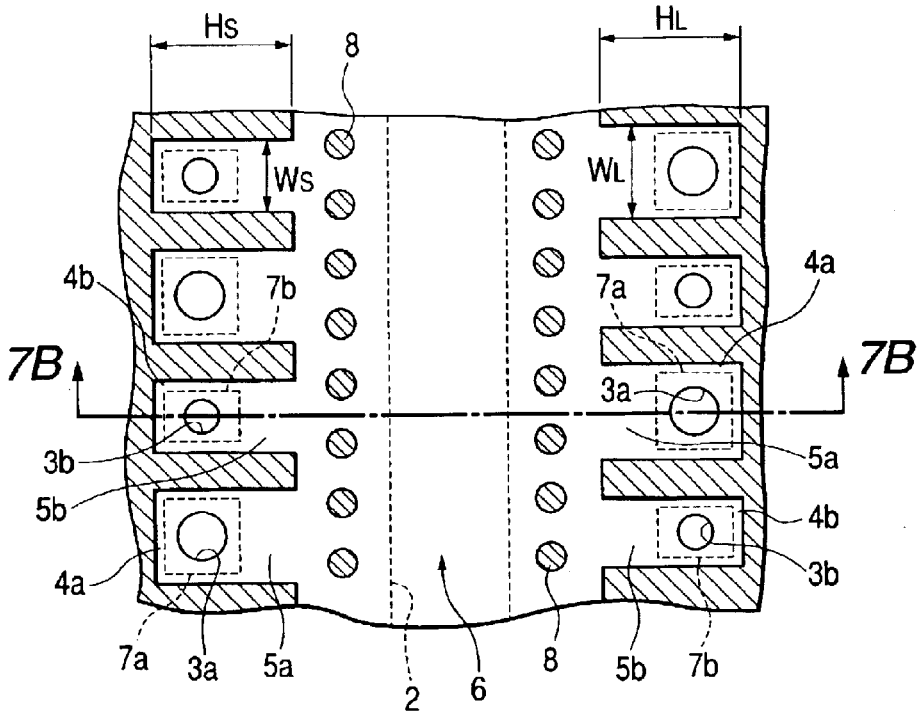
FIG. 7A is an enlarged plan view showing a main part of an ink jet recording head according to a fourth reference example with part of the structure omitted.
Figure 7B:
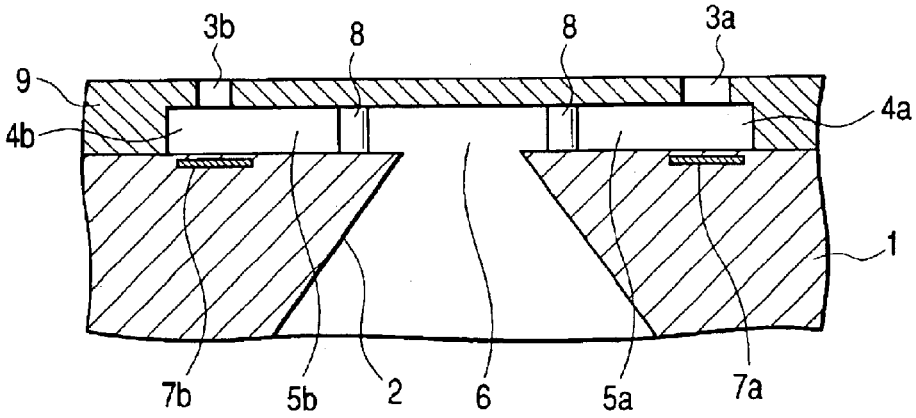
FIG. 7B is a sectional view taken along the line 7B—7B.

Next, an ink jet recording head according to a fourth reference example will be explained with reference to FIGS. 7A and 7B. Explanation of the same parts as those in the first to third reference examples will be omitted.

In this reference example, the small liquid droplet nozzles and the large liquid droplet nozzles are alternately disposed in the same column. The other aspects of construction are the same as those in the second reference example. Accordingly, similar to the third reference example, cross-talk and the influence of the air flow caused when high speed printing is performed by using only the large liquid droplets or small liquid droplets can be reduced, thereby stabilizing the discharging and permitting high speed printing of a high quality image. Further, similar to the second reference example, the flow resistances $S_{Sb}$ of the small liquid droplet ink flow paths 5*b* can be increased without increasing the size of the ink jet recording head.

Third Embodiment

Figure 8A:
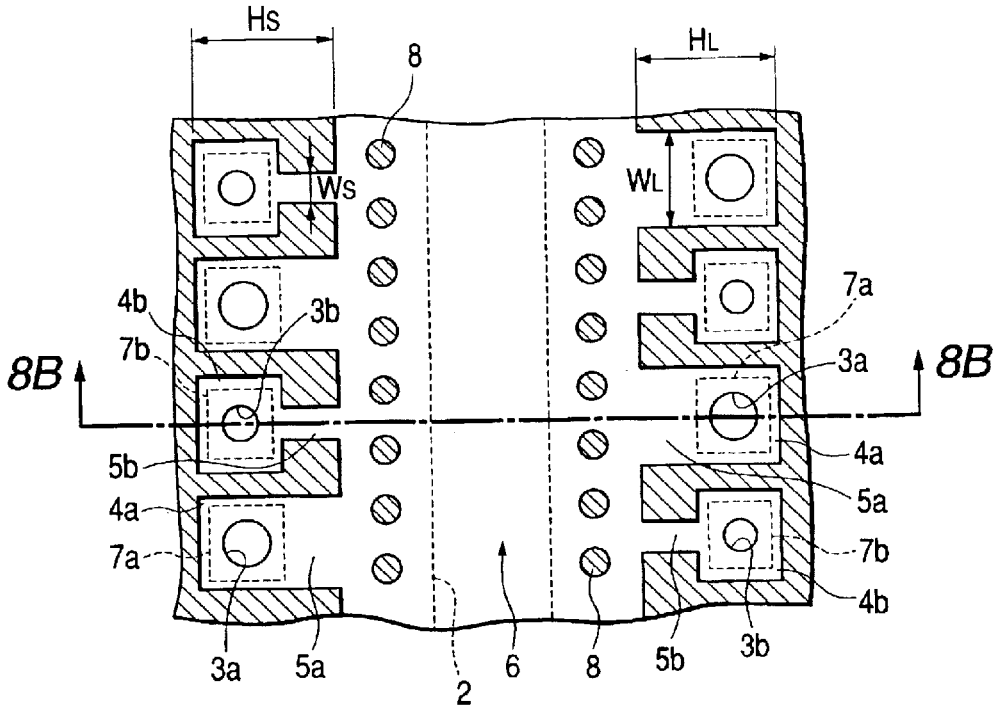
FIG. 8A is an enlarged plan view showing a main part of an ink jet recording head according to a third embodiment of the present invention with part of the structure omitted.
Figure 8B:
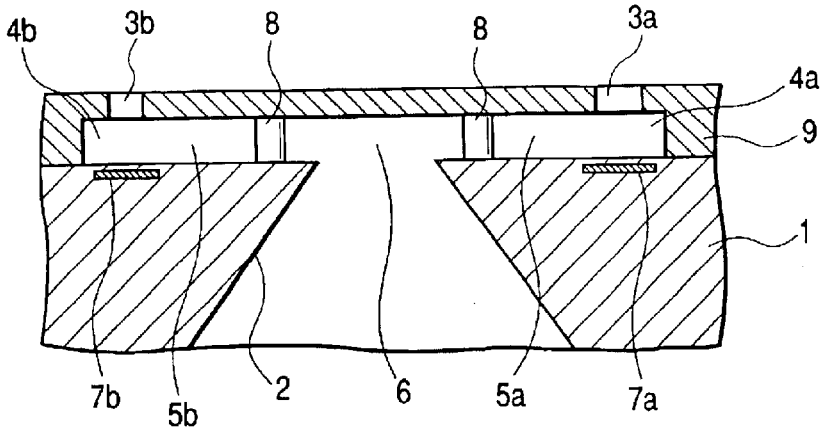
FIG. 8B is a sectional view taken along the line 8B—8B.

Next, a third embodiment of an ink jet recording head of the present invention will be explained with reference to FIGS. 8A and 8B. Explanation of the same parts as those in the first to fourth reference examples and the first and second embodiments will be omitted.

In the third embodiment, the small liquid droplet nozzles and the large liquid droplet nozzles are alternately disposed in the same column. The other aspects of construction are the same as those in the first embodiment. Accordingly, similar to the first embodiment, the degrees of freedom in designing the size of the heater 4*b* are great, with the result that the influence of positional deviation of the nozzle on the discharging direction can be minimized and that the change rate of the effective bubbling area during long term use can be minimized. Further, similar to the fourth reference example, cross-talk and the influence of the air flow caused when high speed printing is performed by using only the large liquid droplets or small liquid droplets can be reduced, thereby stabilizing the discharging and permitting high speed printing of a high quality image, and further, the flow resistances $S_{Sb}$ of the small liquid droplet ink flow paths 5*b* can be increased without increasing the size of the ink jet recording head.

Fourth Embodiment

Figure 9A:
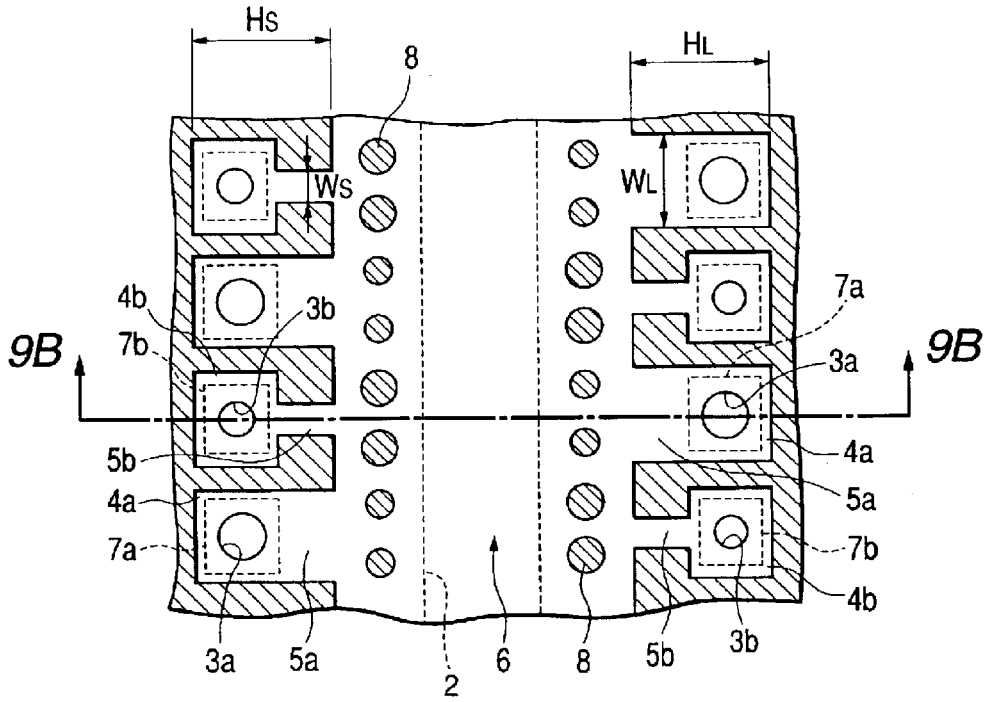
FIG. 9A is an enlarged plan view showing a main part of an ink jet recording head according to a fourth embodiment of the present invention with part of the structure omitted.
Figure 9B:
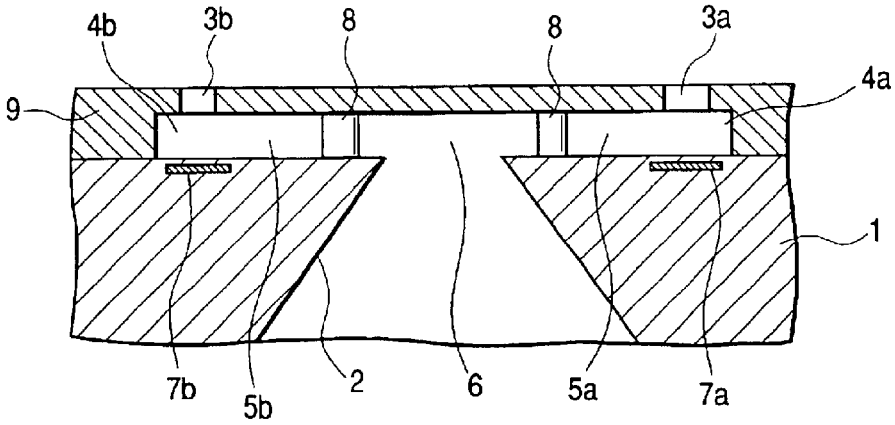
FIG. 9B is a sectional view taken along the line 9B—9B.

Next, a fourth embodiment of an ink jet recording head of the present invention will be explained with reference to FIGS. 9A and 9B. Explanation of the same parts as those in the first to fourth reference examples and the first to third embodiments will be omitted.

In the fourth embodiment, the small liquid droplet nozzles and the large liquid droplet nozzles are alternately disposed in the same column and the diameter of the nozzle filter 8 corresponding to the small liquid droplet ink flow path 5*b* is great. The other aspects of construction are the same as those in the second embodiment. Accordingly, similar to the first embodiment, the degrees of freedom in designing the size of the heater 4*b* are great, with the result that the influence of positional deviation of the nozzle on the discharging direction can be minimized and that the change rate of the effective bubbling area during long term use can be minimized. Further, similar to the fourth reference example, cross-talk and the influence of the air flow caused when high speed printing is performed by using only the large liquid droplets or small liquid droplets can be reduced, thereby stabilizing the discharging and permitting high speed printing of a high quality image, and further, the flow resistances $S_{Sb}$ of the small liquid droplet ink flow paths 5*b* can be increased without increasing the size of the ink jet recording head. Further, similar to the second embodiment, it is hard for the dispersion in the flow resistances $S_{Sb}$ of the nozzles for the small liquid droplet to be so great and thus it is hard for dirt to cause clogging.

Fifth Embodiment

Figure 10A:
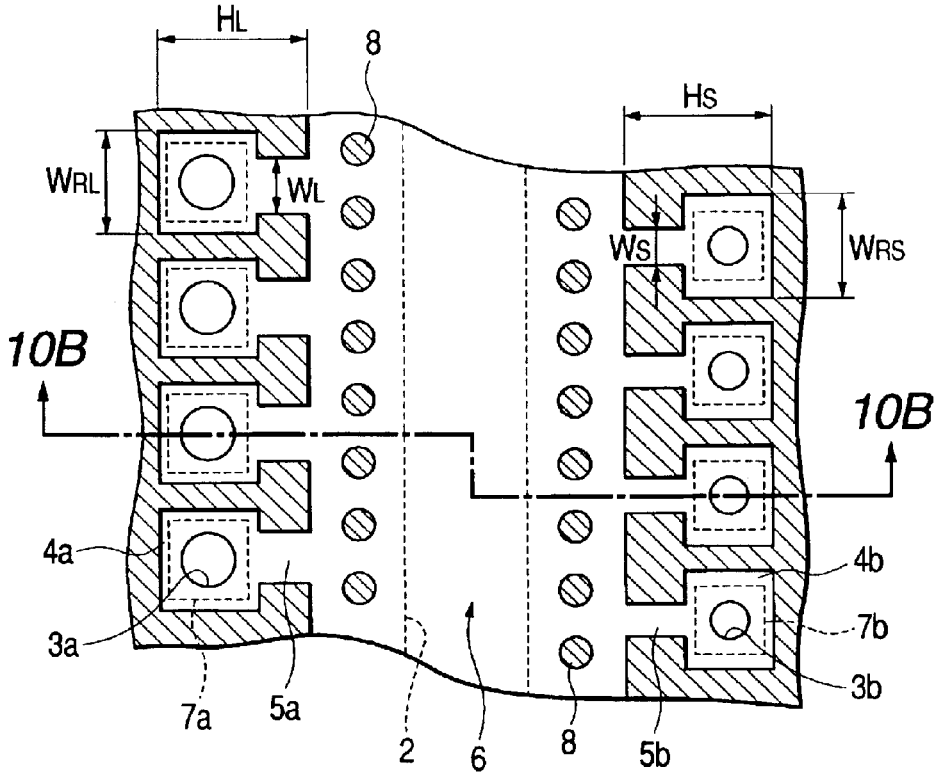
FIG. 10A is an enlarged plan view showing a main part of an ink jet recording head according to a fifth embodiment of the present invention with part of the structure omitted.
Figure 10B:
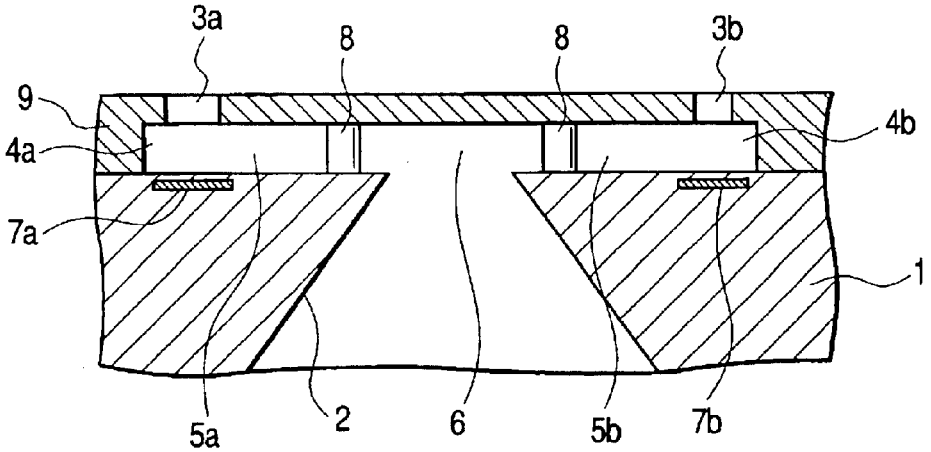
FIG. 10B is a sectional view taken along the line 10B—10B.

Next, a fifth embodiment of an ink jet recording head of the present invention will be explained with reference to FIGS. 10A and 10B. Explanation of the same parts as those in the first to fourth reference examples and the first to fourth embodiments will be omitted.

In the fifth embodiment, the width of the small liquid droplet ink flow path 5*b* is narrower than the width of the small liquid droplet pressure chamber 4*b* and the width of the large liquid droplet ink flow path 5*a* is narrower than the width of the large liquid droplet pressure chamber 4*a* so that both the small liquid droplet ink flow path 5*b* and the large liquid droplet ink flow path 5*a* act as restriction portions for the ink flow. That is to say, if it is assumed that the width of the large liquid droplet pressure chamber is $W_{RL}$, the width of the large liquid droplet ink flow path is $W_L$, the width of the small liquid droplet pressure chamber is $W_{RS}$ and the width of the small liquid droplet ink flow path is $W_S$, $W_{RL} \cong W_{RS}$ and $W_L > W_S$ and $W_S/W_{RS} < W_L/W_{RL}$ are satisfied. The other aspects of construction are the same as those in the first embodiment. Accordingly, in not only the small liquid droplet ink flow paths 5*b* but also the large liquid droplet ink flow paths 5*a*, the flow resistances can be increased without increasing the size of the ink jet recording head. Further, the degrees of freedom in designing the sizes of the heaters 4*a* and 4*b* are great, with the result that the influence of positional deviation of the nozzle on the discharging direction can be minimized and that the change rate of the effective bubbling area during long term use can be minimized.

Example

The inventors manufactured many nozzles and judged the recording properties thereof, the results of which are shown in the following Table 2. The nozzles which were able to achieve good recording are shown by Nos. 4 to 27. Their heater sizes, pressure chambers and pressure chamber widths are given in Table 2. Further, nozzles Nos. 1 to 3 show reference designing examples where the heater size could be reduced.

TABLE 2

| Sample Nozzle | | | | | | Embodiment 1 Heater (12.5 × 28) × 2 Discharged Amount 5.4 (pl) | | Embodiment 2 Heater 26 × 26 Discharged Amount 5.4 (pl) | | Embodiment 3 Heater 30 × 30 Discharged Amount 8.5 (pl) | |
|---|---|---|---|---|---|---|---|---|---|---|---|
| | Discharged | Heater | | Pressure Chamber | | Pressure Chamber | | Pressure Chamber | | Pressure Chamber | |
| No. | Amount (pl) | Size | Total Area | Bottom Area | Width | Bottom Area Ratio | Width Ratio | Bottom Area Ratio | Width Ratio | Bottom Area Ratio | Width Ratio |
| 1 | 0.5 | 12 × 12 | 144 | 256 | 16 | 0.25 | 0.50 | 0.28 | 0.53 | 0.22 | 0.47 |
| 2 | 0.5 | 13 × 13 | 169 | 289 | 17 | 0.28 | 0.53 | 0.32 | 0.57 | 0.25 | 0.50 |
| 3 | 0.5 | 14 × 14 | 196 | 324 | 18 | 0.32 | 0.56 | 0.36 | 0.60 | 0.28 | 0.53 |
| 4 | 0.5 | 16 × 16 | 256 | 400 | 20 | 0.39 | 0.63 | 0.44 | 0.67 | 0.35 | 0.59 |
| 5 | 0.5 | 17 × 17 | 289 | 441 | 21 | 0.43 | 0.66 | 0.49 | 0.70 | 0.38 | 0.62 |
| 6 | 0.5 | 18 × 18 | 324 | 484 | 22 | 0.47 | 0.69 | 0.54 | 0.73 | 0.42 | 0.65 |
| 7 | 0.5 | 19 × 19 | 361 | 529 | 23 | 0.52 | 0.72 | 0.59 | 0.77 | 0.46 | 0.68 |
| 8 | 1.0 | 20 × 20 | 400 | 576 | 24 | 0.56 | 0.75 | 0.64 | 0.80 | 0.50 | 0.71 |
| 9 | 1.0 | 21 × 21 | 441 | 625 | 25 | 0.61 | 0.78 | 0.69 | 0.83 | 0.54 | 0.74 |
| 10 | 2.4 | 22 × 22 | 484 | 676 | 26 | 0.66 | 0.81 | 0.75 | 0.87 | 0.58 | 0.76 |
| 11 | 2.4 | 23 × 23 | 529 | 729 | 27 | 0.71 | 0.84 | 0.81 | 0.90 | 0.63 | 0.79 |
| 12 | 2.4 | 20 × 24 | 480 | 672 | 24 | 0.66 | 0.75 | 0.75 | 0.80 | 0.58 | 0.71 |
| 13 | 2.4 | (11.5 × 27) × 2 | 621 | 930 | 30 | 0.91 | 0.94 | 1.03 | 1.00 | 0.80 | 0.88 |
| 14 | 4.5 | 24 × 24 | 576 | 784 | 28 | 0.77 | 0.88 | 0.87 | 0.93 | 0.68 | 0.82 |
| 15 | 4.5 | 25 × 25 | 625 | 841 | 29 | 0.82 | 0.91 | 0.93 | 0.97 | 0.73 | 0.85 |
| 16 | 5.4 | 26 × 26 | 676 | 900 | 30 | 0.88 | 0.94 | 1.00 | 1.00 | 0.78 | 0.88 |
| 17 | 5.4 | 27 × 27 | 729 | 961 | 31 | 0.94 | 0.97 | 1.07 | 1.03 | 0.83 | 0.91 |
| 18 | 5.4 | (12.5 × 28) × 2 | 700 | 1,024 | 32 | 1.00 | 1.00 | 1.14 | 1.07 | 0.89 | 0.94 |
| 19 | 8.5 | 28 × 28 | 784 | 1,024 | 32 | 1.00 | 1.00 | 1.14 | 1.07 | 0.89 | 0.94 |
| 20 | 8.5 | 29 × 29 | 841 | 1,089 | 33 | 1.06 | 1.03 | 1.21 | 1.10 | 0.94 | 0.97 |
| 21 | 8.5 | 30 × 30 | 900 | 1,156 | 34 | 1.13 | 1.06 | 1.28 | 1.13 | 1.00 | 1.00 |
| 22 | 8.5 | 31 × 31 | 961 | 1,225 | 35 | 1.20 | 1.09 | 1.36 | 1.17 | 1.06 | 1.03 |
| 23 | 8.5 | 32 × 32 | 1,024 | 1,296 | 36 | 1.27 | 1.13 | 1.44 | 1.20 | 1.12 | 1.06 |
| 24 | 8.5 | 33 × 33 | 1,089 | 1,369 | 37 | 1.34 | 1.16 | 1.52 | 1.23 | 1.18 | 1.09 |
| 25 | 8.5 | 34 × 34 | 1,156 | 1,444 | 38 | 1.41 | 1.19 | 1.60 | 1.27 | 1.25 | 1.12 |
| 26 | 8.5 | 35 × 35 | 1,225 | 1,521 | 39 | 1.49 | 1.22 | 1.69 | 1.30 | 1.32 | 1.15 |
| 27 | 8.5 | 36 × 36 | 1,296 | 1,600 | 40 | 1.56 | 1.25 | 1.78 | 1.33 | 1.38 | 1.18 |

What is claimed is:

1. An ink jet recording head in which a plurality of pressure chambers are connected to a plurality of ink flow paths branched from a common liquid chamber, respectively, and a plurality of discharge ports are communicated with said plurality of pressure chambers, respectively, and a plurality of electro-thermal converting elements are disposed within said plurality of pressure chambers, respectively, and inks supplied from said common liquid chamber to said pressure chambers can be discharged from said discharge ports by pressure generated in said pressure chambers by utilizing heat generated by said electro-thermal converting elements, wherein said plurality of pressure chambers include a small liquid droplet pressure chamber for discharging a small liquid droplet and a large liquid droplet pressure chamber for discharging a large liquid droplet, and regarding said ink flow path for discharging a small liquid droplet connected to said small liquid droplet pressure chamber, said small liquid droplet pressure chamber, said ink flow path for discharging a large liquid droplet connected to said large liquid droplet pressure chamber, and said large liquid droplet pressure chamber, when a section substantially perpendicular to ink flows directed from said respective ink flow paths to said respective pressure chambers is considered, a relationship between a sectional area $S_S$ of said small liquid droplet ink flow path, a sectional area $S_{RS}$ of said small liquid droplet pressure chamber, a sectional area $S_L$ of said large liquid droplet ink flow path, and a sectional area $S_{RL}$ of said large liquid droplet pressure chamber satisfies $S_S/S_{RS}<S_L/S_{RL}$.

2. An ink jet recording head according to claim 1, wherein a relationship between the sectional area $S_{RS}$ of said small liquid droplet pressure chamber and the sectional area $S_{RL}$ of said large liquid droplet pressure chamber and an ink amount $I_S$ of the small liquid droplet discharged from said small liquid droplet pressure chamber and an ink amount $I_L$ of the large liquid droplet discharged from said large liquid droplet pressure chamber satisfies $S_{RS}/S_{RL}>I_S/I_L$.

3. An ink jet recording head according to claim 2, wherein $1\geqq S_{RS}/S_{RL}\geqq 0.5$ is satisfied.

4. An ink jet recording head according to claim 3, wherein $1\geqq S_{RS}/S_{RL}\geqq 0.7$ is satisfied.

5. An ink jet recording head according to claim 1, wherein a relationship between a volume $V_{RS}$ of said small liquid droplet pressure chamber and a volume $V_{RL}$ of said large liquid droplet pressure chamber and an ink amount $I_S$ of the small liquid droplet discharged from said small liquid droplet pressure chamber and an ink amount $I_L$ of the large liquid droplet discharged from said large liquid droplet pressure chamber satisfies $V_{RS}/V_{RL}>I_S/I_L$.

6. An ink jet recording head according to claim 5, wherein $1\geqq V_{RS}/V_{RL}\geqq 0.3$ is satisfied.

7. An ink jet recording head according to claim 6, wherein $1\geqq V_{RS}/V_{RL}\geqq 0.5$ is satisfied.

8. An ink jet recording head according to claim 1, wherein the sectional area $S_{RS}$ of said small liquid droplet pressure chamber is substantially the same as the sectional area $S_{RL}$ of said large liquid droplet pressure chamber.

9. An ink jet recording head according to claim 8, wherein $1\geqq S_{RS}/S_{RL}\geqq 0.9$ is satisfied.

10. An ink jet recording head according to claim 8, wherein $S_L=S_{RL}$ and $S_S<S_{RS}$ are satisfied.

11. An ink jet recording head according to claim 1, wherein a volume $V_{RS}$ of said small liquid droplet pressure chamber is substantially the same as a volume $V_{RL}$ of said large liquid droplet pressure chamber.

12. An ink jet recording head according to claim 11, wherein $1\geqq V_{RS}/V_{RL}\geqq 0.8$ is satisfied.

13. An ink jet recording head according to claim 1, wherein the following relationships are satisfied:

$$S_{Lb}\leqq S_{Sb}<1.93\ S_{Lb}$$

$$S_{Lb}=R_{Lf}/(R_{Lf}+R_{Lb})\times S_{Le}$$

$$S_{Sb}=R_{Sf}/(R_{Sf}+R_{Sb})\times S_{Se}$$

where, $S_{Lb}$: flow resistance of large liquid droplet side;

$S_{Sb}$: flow resistance of small liquid droplet side;

$R_{Lf}$: flow resistance from electro-thermal converting element of large liquid droplet pressure chamber to corresponding discharge port;

$R_{Lb}$: flow resistance from electro-thermal converting element of large liquid droplet ink flow path to common liquid chamber;

$S_{Le}$: effective bubbling area of large liquid droplet electro-thermal converting element;

$R_{Sf}$: flow resistance from electro-thermal converting element of small liquid droplet pressure chamber to corresponding discharge port;

$R_{Sb}$: flow resistance from electro-thermal converting element of small liquid droplet ink flow path to common liquid chamber; and $S_{Se}$: effective bubbling area of small liquid droplet electro-thermal converting element.

14. An ink jet recording head according to claim 13, wherein $S_{Lb}\leqq S_{Sb}<1.59\ S_{Lb}$ is satisfied.

15. An ink jet recording head according to claim 13, wherein the following relationships are satisfied:

$$Rf=\eta\int_0^H D(x)dx/S(x)^2$$

$$D(x)=12.0\times(0.33+1.02\times(a(x)/b(x)+b(x)/a(x)))$$

where, $R_f$: flow resistance from electro-thermal converting element to corresponding discharge port;

H: distance from electro-thermal converting element to corresponding discharge port;

x: distance from electro-thermal converting element;

S(x): sectional area of ink flow path at position of distance x;

D(x): section coefficient of ink flow path at position of distance x;

a(x): height of ink flow path at position of distance x;

b(x): width of ink flow path at position of distance x; and

η: ink viscosity, and, $$Rb=\eta\int_0^L D(y)dy/S(y)^2$$

$$D(y)=12.0\times(0.33+1.02\times(c(y)/d(y)+d(y)/c(y)))$$

where, $R_b$: flow resistance from electro-thermal converting element to common liquid chamber;

L: distance from center of electro-thermal converting element to common liquid chamber;

y: distance from common liquid chamber;

S(y): sectional area of ink flow path at position of distance y;

D(y): section coefficient of ink flow path at position of distance y;

c(y): height of ink flow path at position of distance y; and d(y): width of ink flow path at position of distance y.

16. An ink jet recording head according to claim 15, wherein the flow resistance $R_f$ is a flow resistance of said discharge port.

17. An ink jet recording head according to claim 13, wherein the following relationships are satisfied:

$$Rf = \eta \sum_{n=1}^{k} D(x_n)(x_n - x_{n-1})/S(x_n)^2$$

$$D(x_n)=12.0\times(0.33+1.02\times(a(x_n)/b(x_n)+b(x_n)/a(x_n)))$$

where, $R_f$: flow resistance from electro-thermal converting element to corresponding discharge port;

k: division number of distance from electro-thermal converting element to corresponding discharge port;

$x_n$: distance from electro-thermal converting element to n-th division position when distance from electro-thermal converting element to corresponding discharge port is divided into k sections;

$S(x_n)$: sectional area of ink flow path at position of $x_n$;

$D(x_n)$: section coefficient of ink flow path at position of $x_n$;

$a(x_n)$: height of ink flow path at position of $x_n$;

$b(x_n)$: width of ink flow path at position of $x_n$; and

η: ink viscosity, and, $$Rb = \eta \sum_{n=1}^{l} D(y_n)(y_n - y_{n-1})/S(y_n)^2$$

$$D(y_n)=12.0\times(0.33+1.02\times(c(y_n)/d(y_n)+d(y_n)/c(y_n)))$$

where, $R_b$: flow resistance from electro-thermal converting element to common liquid chamber;

l: division number of distance from center of electro-thermal converting element to common liquid chamber;

$y_n$: distance from common liquid chamber to n-th division position when distance from center of electro-thermal converting element to common liquid chamber is divided into l sections;

$S(y_n)$: sectional area of ink flow path at position of $y_n$;

$D(y_n)$: section coefficient of ink flow path at position of $y_n$;

$c(y_n)$: height of ink flow path at position of $y_n$; and $d(y_n)$: width of ink flow path at position of $y_n$.

18. An ink jet recording head according to claim 17, wherein, in said small liquid droplet ink flow path, the following relationship is satisfied:

$$R_f/(R_f+R_b)\times S_e<384\ (\mu m^2)$$

where, $S_e$: effective bubbling area of electro-thermal converting element.

19. An ink jet recording head according to claim 18, wherein, in said small liquid droplet ink flow path, the following relationship is satisfied:

$$199\leqq R_f/(R_f+R_b)\times Se\leqq 317\ (\mu m^2).$$

20. An ink jet recording head according to claim 13, wherein the following relationships are satisfied:

$$Rf = \rho \int_0^H dx/S(x)$$

where, $R_f$: flow resistance from electro-thermal converting element to corresponding discharge port;

H: distance from electro-thermal converting element to corresponding discharge port;

x: distance from electro-thermal converting element;

S(x): sectional area of ink flow path at position of distance x; and

ρ: ink density, and, $$Rb = \rho \int_0^L dy/S(y)$$

where, $R_b$: flow resistance from electro-thermal converting element to common liquid chamber;

L: distance from center of electro-thermal converting element to common liquid chamber;

y: distance from the common liquid chamber; and

S(y): sectional area of ink flow path at position of distance y.

21. An ink jet recording head according to claim 13, wherein the following relationships are satisfied:

$$Rf = \rho \sum_{n=1}^{k} (x_n - x_{n-1})/S(x_n)$$

where, $R_f$: flow resistance from electro-thermal converting element to corresponding discharge port;

k: division number of distance from electro-thermal converting element to corresponding discharge port;

$x_n$: distance from electro-thermal converting element to n-th division position when distance from electro-thermal converting element to corresponding discharge port is divided into k sections;

$S(x_n)$: sectional area of ink flow path at position of $x_n$; and

η: ink viscosity, and, $$Rb = \rho \sum_{n=1}^{l} (y_n - y_{n-1})/S(y_n)$$

where, $R_b$: flow resistance from electro-thermal converting element to common liquid chamber;

l: division number of distance from center of electro-thermal converting element to common liquid chamber;

$y_n$: distance from common liquid chamber to n-th division position when distance from center of electro-thermal converting element to common liquid chamber is divided into l sections; and $S(y_n)$: sectional area of ink flow path at position of $y_n$.

22. An ink jet recording head according to claim 1, wherein an ink amount of the small liquid droplet is below 4 pl.

23. An ink jet recording head according to claim 1, wherein distances between said discharge ports and said electro-thermal converting elements, respectively, are substantially the same as each other regardless of a size of the ink droplet to be discharged.

24. An ink jet recording head according to claim 1, wherein said plurality of discharge ports are formed in the same substrate regardless of a size of the ink droplet to be discharged.

25. An ink jet recording head according to claim 1, wherein, at one side of said common liquid chamber, only said ink flow paths, pressure chambers and discharge ports for discharging ink droplets having the same size are connected side by side.

26. An ink jet recording head according to claim 1, wherein, at one side of said common liquid chamber, only said ink flow paths, pressure chambers and discharge ports for discharging ink droplets having different sizes are connected alternately side by side.

27. An ink jet recording head according to claim 1, wherein a nozzle filter is disposed between said ink flow paths and said common liquid chamber.

28. An ink jet recording head according to claim 27, wherein said nozzle filter provided between said small liquid droplet ink flow path and said common liquid chamber is greater than said nozzle filter provided between said large liquid droplet ink flow path and said common liquid chamber.

29. An ink jet recording head according to claim 1, wherein a driving pulse width Pw of said electro-thermal converting elements driven within said pressure chambers, respectively, is smaller than 1.4 $\mu$s.

30. An ink jet recording head according to claim 29, wherein the driving pulse width Pw of said electro-thermal converting elements is smaller than 1.2 $\mu$s.

* * * * *

UNITED STATES PATENT AND TRADEMARK OFFICE

CERTIFICATE OF CORRECTION

PATENT NO. : 6,830,317 B2
DATED : December 14, 2004
INVENTOR(S) : Ken Tsuchii et al.

It is certified that error appears in the above-identified patent and that said Letters Patent is hereby corrected as shown below:

Column 4,
Line 1, "Further," should read -- ¶ Further, --.

Column 18,
Line 19, "<1.59" should read -- ≤1.59 --.

Signed and Sealed this

Seventh Day of June, 2005

JON W. DUDAS
*Director of the United States Patent and Trademark Office*